United States Patent [19]

Pasternack

[11] 4,253,328

[45] Mar. 3, 1981

[54] DEVICE FOR ENCLOSING A PERSON'S HEAD TO TEST A BREATHING MASK

[75] Inventor: Adalbert Pasternack, Bad Schwartau, Fed. Rep. of Germany

[73] Assignee: Drägerwerk Aktiengesellschaft, Fed. Rep. of Germany

[21] Appl. No.: 105,016

[22] Filed: Dec. 19, 1979

[30] Foreign Application Priority Data

Dec. 23, 1978 [DE] Fed. Rep. of Germany ..... 2856100

[51] Int. Cl.[3] ..... G01M 3/20

[52] U.S. Cl. ..... 73/40.7; 128/201.23

[58] Field of Search ..... 73/40, 40.7; 128/201.24, 201.27, 201.29, 201.23, 206.21, 206.23, 206.24, 206.25

[56] References Cited

U.S. PATENT DOCUMENTS 4,146,025 3/1979 Warncke et al. ..... 73/40.7 X

*Primary Examiner*—Gerald Goldberg
*Assistant Examiner*—Joseph W. Roskos
*Attorney, Agent, or Firm*—McGlew & Tuttle

[57] ABSTRACT

A device for enclosing a person's head which is fitted with a breathing mask for the purpose of testing the sealing of the mask to the wearer's face comprises a substantially cylindrical rigid helmet having a closed top adapted to overly the wearer's head and an open front portion adapted to be positioned in front of the wearer's face which is bounded by a front rim and side portions having bottom edges which have cut out curved portions forming supporting engagement edges conforming to the wearer's shoulders. A flexible apron has its periphery secured to the helmet rim around at least a portion of the opening and it carries drawstrings at its bottom edge which may be tightened around the body of the wearer so that the helmet with the apron seals over the person's head. In addition the helmet is provided with a connection having a valve for admitting gases into the interior of the helmet for testing purposes and the valve advantageously has a stem which is long enough to be engaged by the person's shoulder when the device is positioned on the wearer. Engagement of the valve on the shoulder causes opening of the valve.

4 Claims, 2 Drawing Figures

DEVICE FOR ENCLOSING A PERSON'S HEAD TO TEST A BREATHING MASK

FIELD AND BACKGROUND OF THE INVENTION

This invention relates in general to breathing masks and in particular to a new and useful device for testing the sealing capability of the mask.

The tight fit of oxygen masks is at least as important as the purely technical operation as far as the efficiency of the respirator is concerned. The efficiency is limited in practice more by an insufficiently tight fit of the oxygen mask and the tight connection of the respirator than by operational failure or other possible leakages.

A known device for testing the tight fit of oxygen masks on the wearer contains as an essential part a hood of transparent material, for example, plastic sheet. It has an expiration air connection tightly traversing the material of the hood, which can be connected to the expiration valve of the mask, with a receiver for gas testing tubes. In another opening of the hood, material is arranged, the nipple of the oxygen mask for the filter, and the ventilating air supply, from a respirator is sealed by means of a gasket. The hood is tightly sealed from the surrounding atmosphere by a collar around the neck of the mask wearer. The test gas is introduced into the hood through another tight connection. In order to test the tightness of the oxygen mask, the hood is filled with test gas. In case of leakage, it penetrates into the interior of the mask during respiration. It mixes there with the ventilating air sucked in by the wearer. During its passage, it can be tested by means of the gas testing device, e.g. a testing tube for determining the gas type and thus also the tightness or untightness. A disadvantage of this testing device is the requirement for a time-consuming attachment of the hood and the impossibility of checking an important leakage point, namely, the connection of the ventilating air supply from the respirator (DAS No. 26 51 217).

Another known device for testing the tightness of oxygen masks on the wearer consists of a hood terminating on the body, with an additional tight-fitting inner hood. The inner hood is connected over a line to a test gas source. The test gas enters the inner hood, passes through it and flows then off over the outer hood terminating on the body through an exhaust to the outside. The interior of the mask between the oxygen mask and the covered portions of the head of the wearer is connected over a connection line to a test gas meter which measures directly the test gas concentrations in the interior of the mask, hence a possible leakage in the seal and/or other leakages. This device is complicated because of the two hoods with the difficult handling of the inner hood. The testing procedure is time-consuming; the test gas consumption is high (DAS No. 26 52 136).

SUMMARY OF THE INVENTION

The invention provides a test gas hood for oxygen masks which permits a time-saving tightness test and which has a low test gas consumption.

In accordance with the invention a helmet is provided for a wearer of a mask which fits over the person's head and engages on his shoulder and includes an apron which may be secured in front of the person so as to tightly seal the head area while the person is wearing a breathing mask. Test gas is admitted into the helmet space by opening of a valve which advantageously is opened when the device is positioned on the person.

The advantages achieved with the invention are seen particularly in the time-saving testing of the tightness of the oxygen mask and its ventilating air connections. When it is necessary to rescue people and goods from highly toxic atmospheres, the rescuers must be able to act as soon as possible. Nevertheless the tightness test must be reliable and safe. Particularly in these atmospheres, minor leakages can be very dangerous, if not fatal for the rescuers. The test gas consumption is kept low, since the test gas supply into the hood is limited, by the automatic dosing value to the actual time of use. This practically ensures that the necessary test gas is also available for unforseen periods.

Accordingly it is an object of the invention to provide an improved sealing helmet which is fittable over a person wearing a breathing mask for the purpose of admitting a gas into the area enclosed by the helmet and which includes an apron which may be tightened over the person so as to seal the space within the helmet and valve means associated with the helmet for admitting gas into the helmet for testing the mask.

A further object of the invention is to provide a device for testing the sealing capability of a breathing mask which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
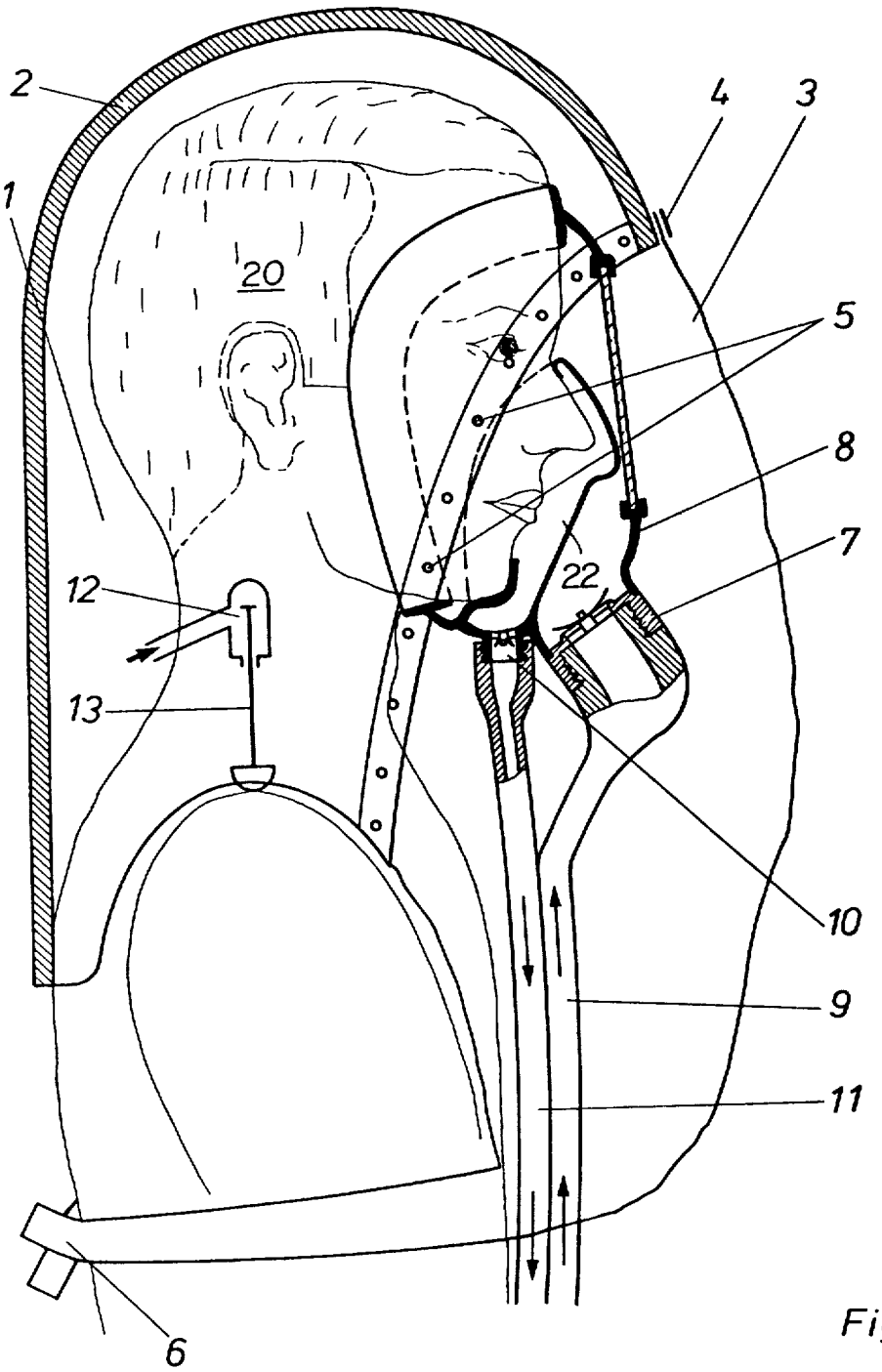
FIG. 1 is a transverse sectional view partly schematic showing a device for testing a breathing mask constructed in accordance with the invention.
Figure 2:
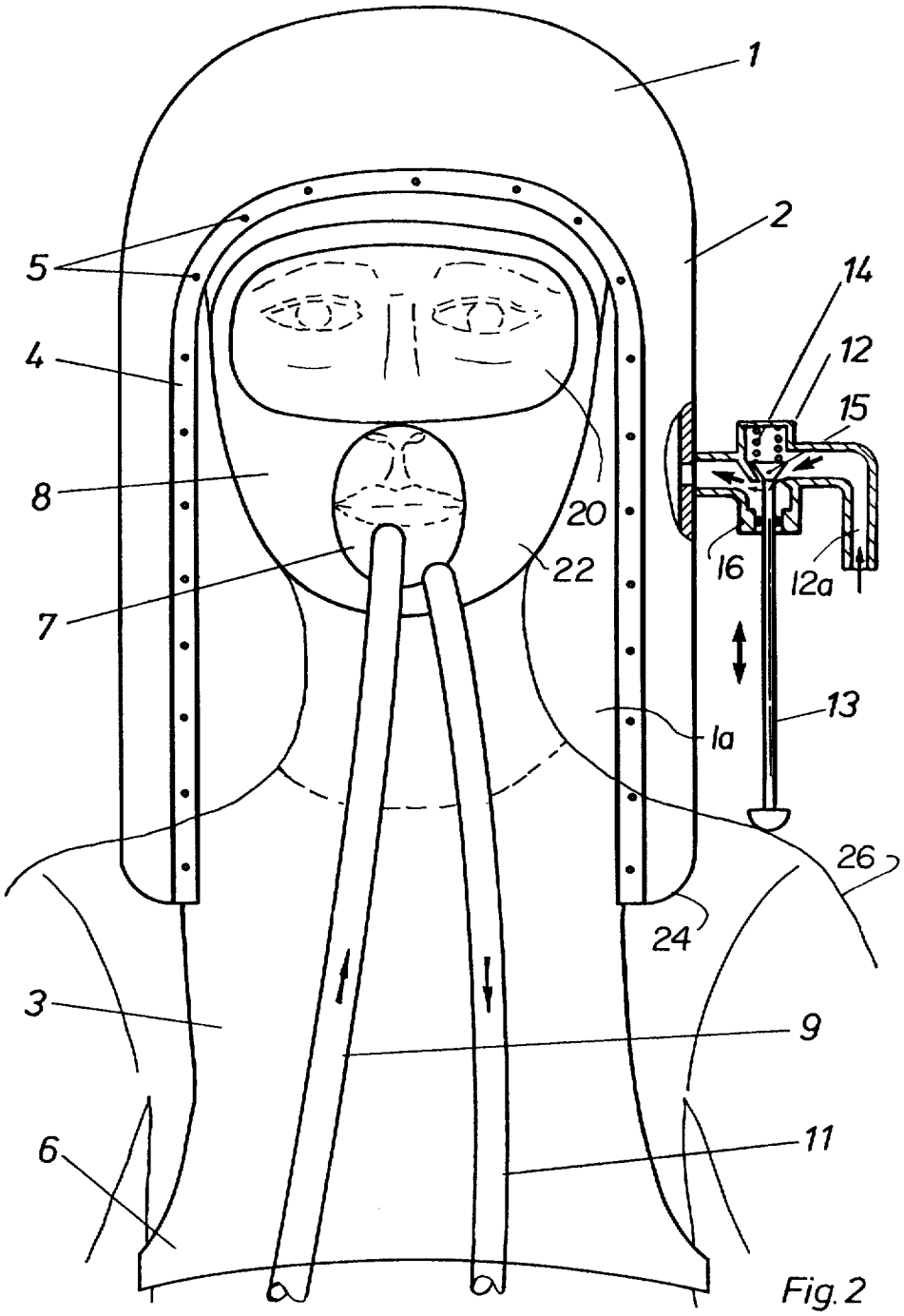
FIG. 2 is a front view of the device shown in FIG. 1.

Referring to the drawings, in particular the invention embodied therein comprises a device for enclosing a person's head 20 which is fitted with a breathing mask 22 for the purpose of testing the sealing of the mask to the wearer's face.

In accordance with the invention the device includes a substantially cylindrical rigid helmet generally designated 1 having a closed top and adapted to overly the wearer's head. An open front portion 1a is positioned at the front of the wearer ahead of his face and it is bounded by a rim 4. The side wall portion 24 of the helmet 1 are contoured to engage upon the shoulder 26 of the wearer 20 and to snugly engage around the person's head. With the exception of the part opposite the face of the wearer, test gas hood 1 comprises a fixed transparent shell part 2 having a front opening part and of a flexible transparent apron 3, which covers the open part. Apron 3 is secured to the shell part 2 by means of a U-shaped pressure part bar 4 and screws or rivets 5. The apron 3 has bottom ends 6 which are tied together on the back of the wearer. Apron 3 fits snugly on the wearer's body. Both a ventilating air hose 9, connection piece 7 of oxygen mask 8, and an expiration air tube 11 overlapping expiration valve 10 fit snugly against the wearer's body. The valve 10 is also used for gas sampling.

An economical dosage of the test gas, which is only related to the testing procedure, is ensured by dosing valve 12. It is secured directly on shell part 2 and is connected to a test gas supply through connection 12*a*. Dosing valve 12 is actuated by a valve stem 13 which projects outwardly of housing 16. When test gas hood 1 is in place, the stem 13 bears on the shoulder of the wearer and is moved in opening direction of dosing valve 12. Test gas thus flows only when test gas hood 1 is put on. When it is taken off, spring 14 presses closing disk 15 on the valve seat and closes thus dosing valve 12.

While specific embodiments of the invention have been shown and described in detail to illustrate the application of the principles of the invention, it will be understood that the invention may be embodied otherwise without departing from such principles.

What is claimed is:

1. A device for enclosing a person's head which is fitted with a breathing mask for the purpose of testing the sealing of the mask to the wearer's face, comprising a substantially cylindrical rigid helmet having a closed top adapted to overly the wearer's head and an open front portion adapted to be positioned in front of the wearer's face, said open front portion being bounded by a front rim, said helmet further including side wall portion and upwardly curved edges for closely engaging and supporting the helmet on the wearer's shoulders, a flexible apron having a periphery secured to said rim around at least a portion of the opening and extending downwardly from the helmet to overly the wearer's body, drawstring means associated with the lower end of said apron for engaging said apron with the wearer's body to seal the helmet, and valve means connected to said helmet for admitting a test gas into said helmet.

2. A device according to claim 1 wherein said valve means includes a movable valve member and means engageable with the wearer to move said valve member to open said valve means when the helmet is engaged on a person's body.

3. A device according to claim 1 including a connection for a test gas extending into said helmet, a valve in said connection for opening and closing said connection, said valve including a portion engageable by the person to open the valve when the helmet is positioned on the person.

4. A device according to claim 1 wherein said valve member includes an elongated stem having an end portion engageable on a person's shoulder when the helmet is positioned on the shoulder so as to open the valve and permit the test gas to flow therein.

* * * * *